US006742567B2

(12) United States Patent
Winterbottom et al.

(10) Patent No.: US 6,742,567 B2
(45) Date of Patent: Jun. 1, 2004

(54) APPARATUS FOR AND METHOD OF PRODUCING SLURRY MATERIAL WITHOUT STIRRING FOR APPLICATION IN SEMI-SOLID FORMING

(75) Inventors: Walter L. Winterbottom, Jackson, TN (US); Dan V. Chirieac, Somerset, KY (US); Jason M. Unruh, Jackson, TN (US); Jian Lu, Ballwin, MO (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/932,610

(22) Filed: Aug. 17, 2001

(65) Prior Publication Data

US 2003/0037900 A1 Feb. 27, 2003

(51) Int. Cl.[7] ..... B22D 17/00
(52) U.S. Cl. ..... 164/113; 164/900
(58) Field of Search ..... 164/113, 900, 164/312, 119

(56) References Cited

U.S. PATENT DOCUMENTS

| | | | | |
|---|---|---|---|---|
| 4,106,956 A | | 8/1978 | Bercovici | 148/11.5 |
| 4,415,374 A | | 11/1983 | Young et al. | 148/2 |
| 4,555,272 A | | 11/1985 | Ashok et al. | 148/3 |
| 5,803,154 A | | 9/1998 | Sugawara et al. | 164/120 |
| 5,979,534 A | * | 11/1999 | Shibata et al. | 164/113 |
| 6,120,625 A | | 9/2000 | Zhou et al. | 148/690 |
| 6,311,759 B1 | * | 11/2001 | Tausig et al. | 164/113 |

FOREIGN PATENT DOCUMENTS

| | | |
|---|---|---|
| EP | 0 701 002 A1 | 3/1996 |
| EP | 0 745 694 A1 | 12/1996 |
| EP | 0 841 406 A1 | 5/1998 |
| EP | 0 903 193 A1 | 3/1999 |

OTHER PUBLICATIONS

U.S. patent application Ser. No. 09/584,859, Lombard et al., filed Jun. 1, 2000.
U.S. patent application Ser. No. 09/585,061, Norville et al., filed Jun. 1, 2000.

* cited by examiner

*Primary Examiner*—Tom Dunn
*Assistant Examiner*—Len Tran
(74) *Attorney, Agent, or Firm*—Woodard, Emhardt, Moriarty, McNett & Henry LLP

(57) ABSTRACT

A method of producing a semi-solid material without stirring, including heating a metal alloy to form a metallic melt, transferring a select amount of the melt into a vessel, nucleating the melt by regulating the transferring of the melt into the vessel, and crystallizing the melt within the vessel by cooling the melt at a controlled rate to produce a semi-solid material having a microstructure comprising rounded solid particles dispersed in a liquid metal matrix. In one form of the invention, a temperature-controlled shot sleeve is provided for receiving and cooling an amount of metallic melt at a controlled rate to produce the semi-solid material. The shot sleeve has a number of heat transfer zones adapted to independently control the temperature of the melt disposed adjacent various portions of the shot sleeve. The shot sleeve also includes a ram operable to discharge the semi-solid material directly into a die mold to form a near-net-shape part.

45 Claims, 10 Drawing Sheets

APPARATUS FOR AND METHOD OF PRODUCING SLURRY MATERIAL WITHOUT STIRRING FOR APPLICATION IN SEMI-SOLID FORMING

BACKGROUND OF THE INVENTION

The present invention relates generally to a system for producing metallic material for use in a forming process. More particularly, the present invention relates to an apparatus for and method of producing a semi-solid slurry material from a molten metal under controlled cooling conditions and without stirring for application in a semi-solid forming process.

In general, the field of semi-solid processing can be divided into two categories: thixocasting and rheocasting. In the thixocasting process, also referred to as an indirect feed process, the microstructure of the solidifying alloy is modified from a dendritic form to a discrete degenerated dendritic form before the alloy is cast into a solid billet. The solid billet is then re-heated to a partially melted, semi-solid state and then cast into a mold to produce a shaped part. In the rheocasting process, also referred to as a direct feed process, a slurry is produced in a forming vessel by cooling a liquid metal to a semi-solid state while its microstructure is modified. The semi-solid slurry is then delivered as feedstock directly to a forming press to produce a shaped part.

An example of a prior art indirect feed apparatus 10 for use in a thixocasting process is illustrated in FIG. 1. Liquid molten metal alloy M is fed into a mold 12 that is surrounded by an electromagnetic stator 14. In some prior art systems, the stator 14 is replaced by a mechanical stirring device. The electromagnetic stator 14 imparts a rotating electromagnetic field to the metal alloy M as it begins to solidify within the mold 12. The electromagnetic stirring causes a type of shearing of the alloy in its semi-solid state so that the microstructure of the primary solid particles is transformed from a dendritic state into a partially dendritic state which includes globular particles suspended in a liquid eutectic phase. As the partially solidified metal alloy M exits the mold 12, it is cooled by means of a water jacket to completely solidify the alloy into a raw billet 16. The raw billet 16 may then be cut into a number of slugs 18. Before the solidified billets 16 or slugs 18 can be processed, they are transported to a processing station where they are reheated by an induction heater 20 to transform the material back into a semi-solid state. The semi-solid material is then transferred from the induction heater 20 to a die casting machine 22 where the semi-solid material is injected into a mold 24 by means of an injection mechanism 26 to form a shaped part.

The indirect feed process typically requires complex processing equipment and numerous process steps, each having a tendency to correspondingly increase equipment and operating costs. For example, the capital expenditures and maintenance costs associated with the electromagnetic stator 14 and the induction heater 20 can be substantial. Additionally, production costs can be quite high due to the numerous process steps, including the steps of stirring the alloy, handling and processing the raw billet, and the reheating the raw billets to a semi-solid state. Moreover, due to the complexity of the overall system, cycle times are quite high.

An example of a prior art direct feed apparatus 30 for use in a rheocasting process is illustrated in FIG. 2. Similar to the indirect feed process, liquid molten metal alloy M is fed into a vessel 32 which is surrounded by an electromagnetic stator 34. However, instead of forming a completely solidified billet, the direct feed process produces a partially-solidified semi-solid material that is discharged from vessel 32 into a shot sleeve 36. The semi-solid material is then injected into a mold 38 by means of an injection mechanism 40 to form a shaped part. Another example of a direct feed apparatus is disclosed in U.S. patent application Ser. No. 09/585,061, filed on Jun. 1, 2000 and entitled "Apparatus and Method of Producing On-Demand Semi-Solid Material For Castings", the contents of which are incorporated herein by reference.

Although the direct feed process is somewhat less complex than the indirect feed process, the equipment and operating costs can still be substantial due to the capital expenditures and maintenance costs associated with the electromagnetic stator 34. Additionally, production costs can also be quite high due to the multiple process steps associated with producing the semi-solid material in the vessel 32, and subsequently transferring the semi-solid material into the shot sleeve 36. Moreover, cycle times associated with the direct feed process can be quite high due to the complexity of the overall system and the multiple process steps.

In prior direct and indirect feed processes, semi-solid slurry material is typically produced by stirring a molten metal while simultaneously cooling the molten metal at a relatively high rate, usually in excess of 1 degree Celsius per second. Such stirring has typically been accomplished by either mechanical stirring or electromagnetic stirring. Vigorous stirring of the molten metal causes the molten alloy to change from a dendritic microstructure to a partially dendritic, globular microstructure. The step of stirring the molten alloy during solidification was developed in response to an assumption that a fully dendritic slurry microstructure normally formed during rapid solidification is not a desirable feature and would negatively affect part quality. Instead of stirring, semi-solid slurry material has also been produced by agitating the molten metal, such as by low frequency vibration, high-frequency wave, electric shock, or electromagnetic wave. Equiaxed nucleation has also been used to produce semi-solid slurry, which typically involves rapid under-cooling and the addition of grain refiners. Additionally, Oswald ripening and coarsening has been used to produce semi-solid slurry, which involves holding the metal alloy at a steady semi-solid temperature for a long period of time.

An example of a fully solidified dendritic microstructure formed without stirring or agitation and under rapid solidification is illustrated in FIG. 3. In the early stages of semi-solid slurry formation, dendritic particles nucleate and grow as equiaxed dendrites (envision a symmetric snow flakes) within the molten metal. The dendritic particle branches grow larger and the dendrite arms coarsen so that the primary and secondary dendrite arm spacing increases. During this growth stage in the solidification process, the dendrites impinge and become tangled with the remaining liquid phase occupying the inter-dendritic volume. At this point the viscosity of the slurry increases abruptly.

In the past, it was believed that a semi-solid material formed without stirring would have a higher viscosity than a semi-solid material formed with stirring. It was also believed that higher viscosities would adversely affect die fill. It has additionally been observed that electromagnetic and/or mechanical stirring fractures the dendritic structure formed during partial solidification of the semi-solid material. Such fracturing of the dendritic structure provides a mixture of both liquid and nodular (rounded) solid particles. The mixture of particles and liquid of the stirred formation has a sufficiently low viscosity that is thought to be favorable for the semi-solid formation of shaped parts.

Although processes that utilize stirring or other forms of agitation have been found to produce adequate results, the cost and complexity of the associated equipment is relatively high, thereby having the effect of increasing capital expenditures and maintenance costs. Further, the number and complexity of the required process steps is also increased, which also has a tendency to correspondingly increase costs. Additionally, while the use of grain refiners has proven to be somewhat successful in modifying the microstructure of a metallic alloy, the costs associated with this semi-solid production method are relatively high due to the initial cost of the grain refiners and the expense associated with recycling. Furthermore, while the Oswald ripening and coarsening method has had some degree of success in the formation of semi-solid material, this method involves lengthy processing times which correspondingly increases cycle times.

Heretofore, there has been a need for an apparatus for and method of producing a semi-solid slurry material from a molten metal under controlled cooling conditions and without stirring for application in a semi-solid forming process. The present invention satisfies this need in a novel and non-obvious way.

SUMMARY OF THE INVENTION

One form of the present invention contemplates a method of producing a semi-solid material without stirring. The method comprises heating a metal alloy to form a metallic melt, transferring an amount of the metallic melt into a vessel, nucleating the metallic melt by regulating the transferring of the metallic melt into the vessel, and crystallizing the metallic melt in the vessel by cooling the metallic melt at a controlled rate to produce a semi-solid material having a microstructure comprising rounded solid particles dispersed in a liquid metal matrix.

Another form of the present invention contemplates an apparatus for producing semi-solid material without stirring. The apparatus comprises a furnace adapted to heat a metal alloy to form a metallic melt, and a temperature-controlled vessel adapted to receive and cool an amount of the metallic melt at a controlled rate to form a semi-solid material having a microstructure comprising rounded solid particles dispersed in a liquid metal matrix. The temperature-controlled vessel has a plurality of heat transfer zones, each adapted to independently control the temperature of the metallic melt disposed adjacent thereto.

Still another form of the present invention contemplates an apparatus for producing semi-solid material suitable for semi-solid forming a shaped part. The apparatus comprises a furnace adapted to heat a metal alloy to form a metallic melt, a temperature-controlled vessel having a passage adapted to receive and cool an amount of the metallic melt at a controlled rate to cause the metallic melt to crystallize and form a semi-solid material having a microstructure comprising rounded solid particles dispersed in a liquid metal matrix, and a ram displaceable along the passage to discharge the semi-solid material therefrom.

One object of the present invention is to provide an improved method of producing semi-solid slurry material for application in semi-solid forming.

Another object of the present invention is to provide an improved apparatus for producing semi-solid slurry material for application in semi-solid forming.

Further objects of the present invention will become apparent from the following description and illustrations.

DESCRIPTION OF THE PREFERRED EMBODIMENTS

Figure 1:
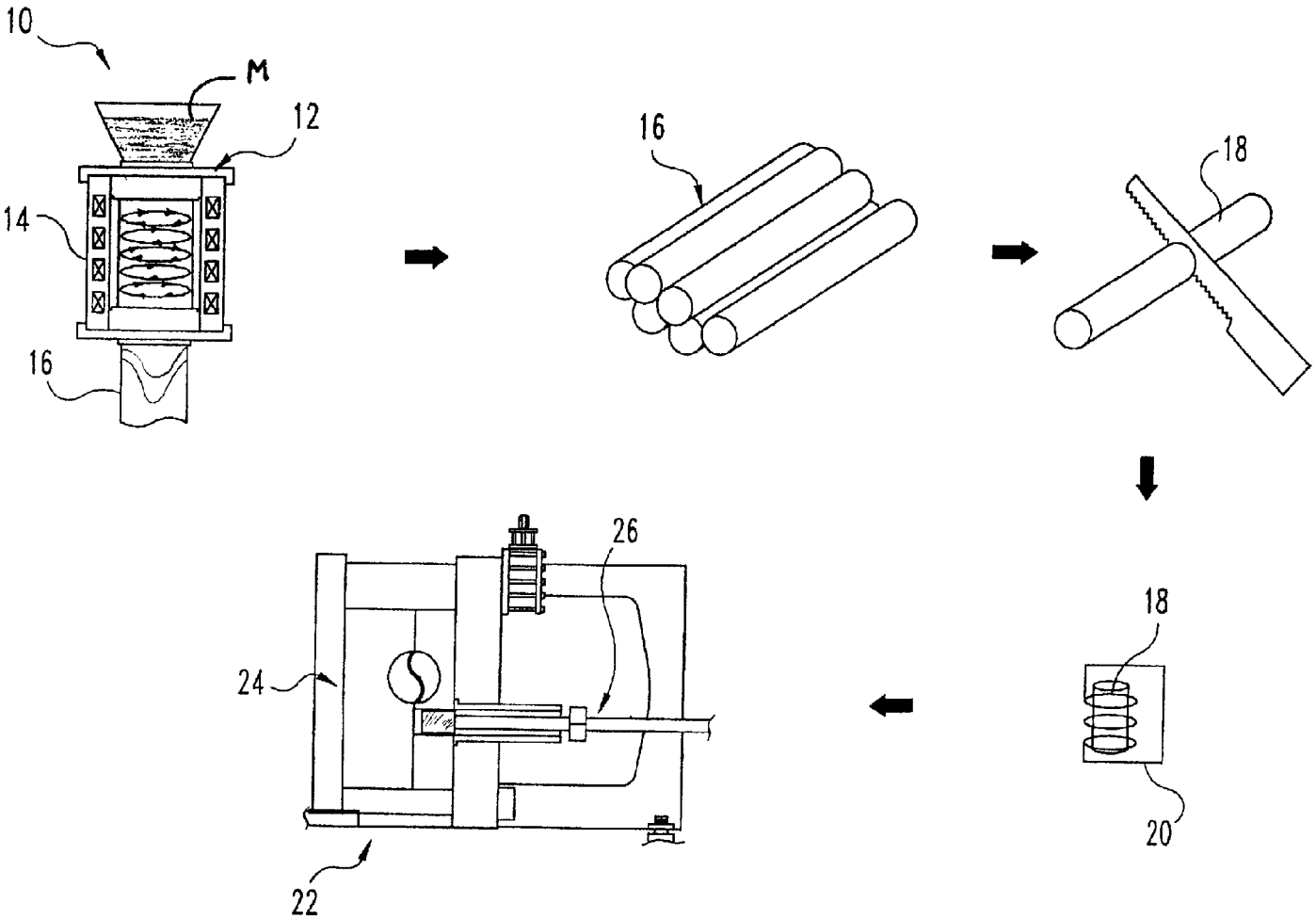
Fig. 1 (PRIOR ART)
FIG. 1 is a diagrammatic process flow diagram illustrating a prior art process for forming non-dendritic semi-solid material by way of an indirect feed apparatus.
Figure 2:
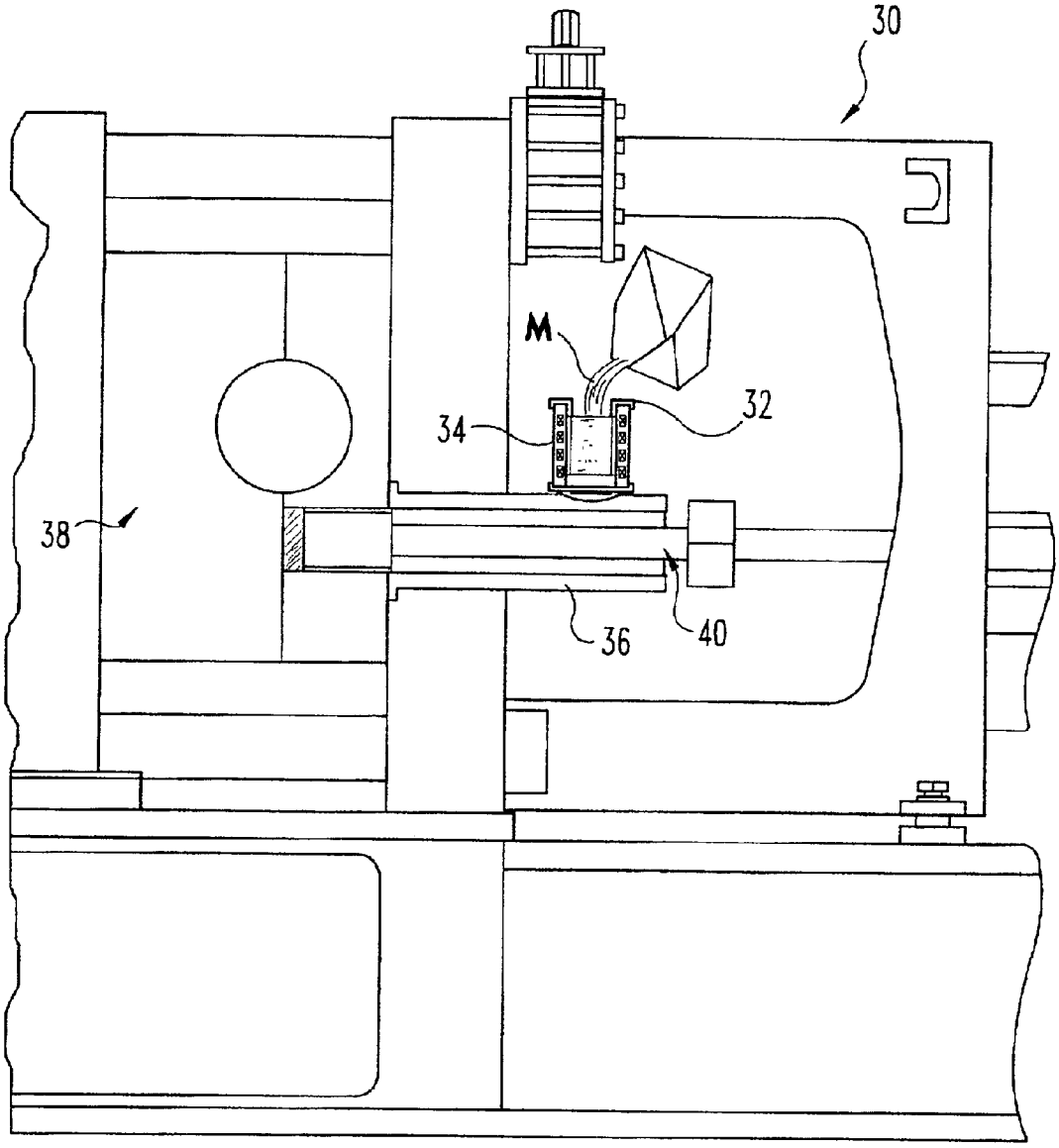
Fig. 2 (PRIOR ART)
FIG. 2 is a diagrammatic process flow diagram illustrating a prior art process for forming non-dendritic semi-solid material by way of a direct feed apparatus.
Figure 3:
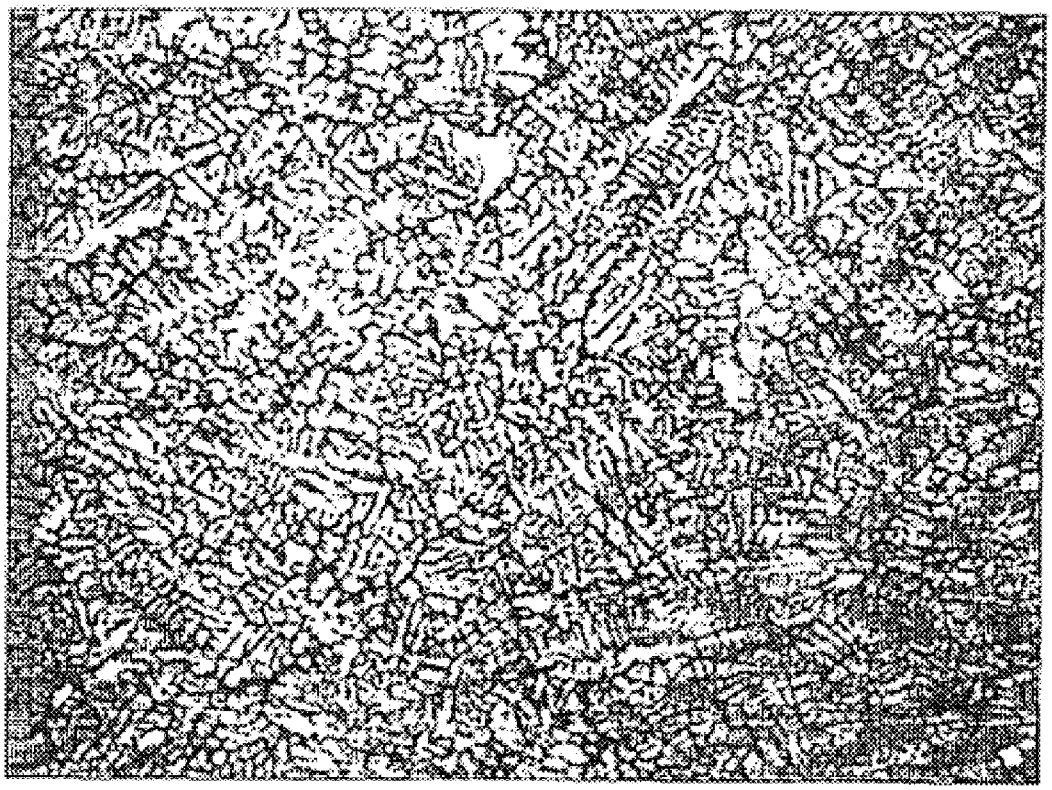
Fig. 3 (PRIOR ART)
FIG. 3 is a photomicrograph at a magnification of 100×, illustrating a fully solidified dendritic microstructure formed without stirring and under rapid solidification.

For the purposes of promoting an understanding of the principles of the invention, reference will now be made to the embodiments illustrated in the drawings and specific language will be used to describe the same. It will nevertheless be understood that no limitation of the scope of the invention is hereby intended, any alterations and further modifications in the illustrated device and method, and any further applications of the principles of the invention as illustrated herein being contemplated as would normally occur to one skilled in the art to which the invention relates.

Figure 4:
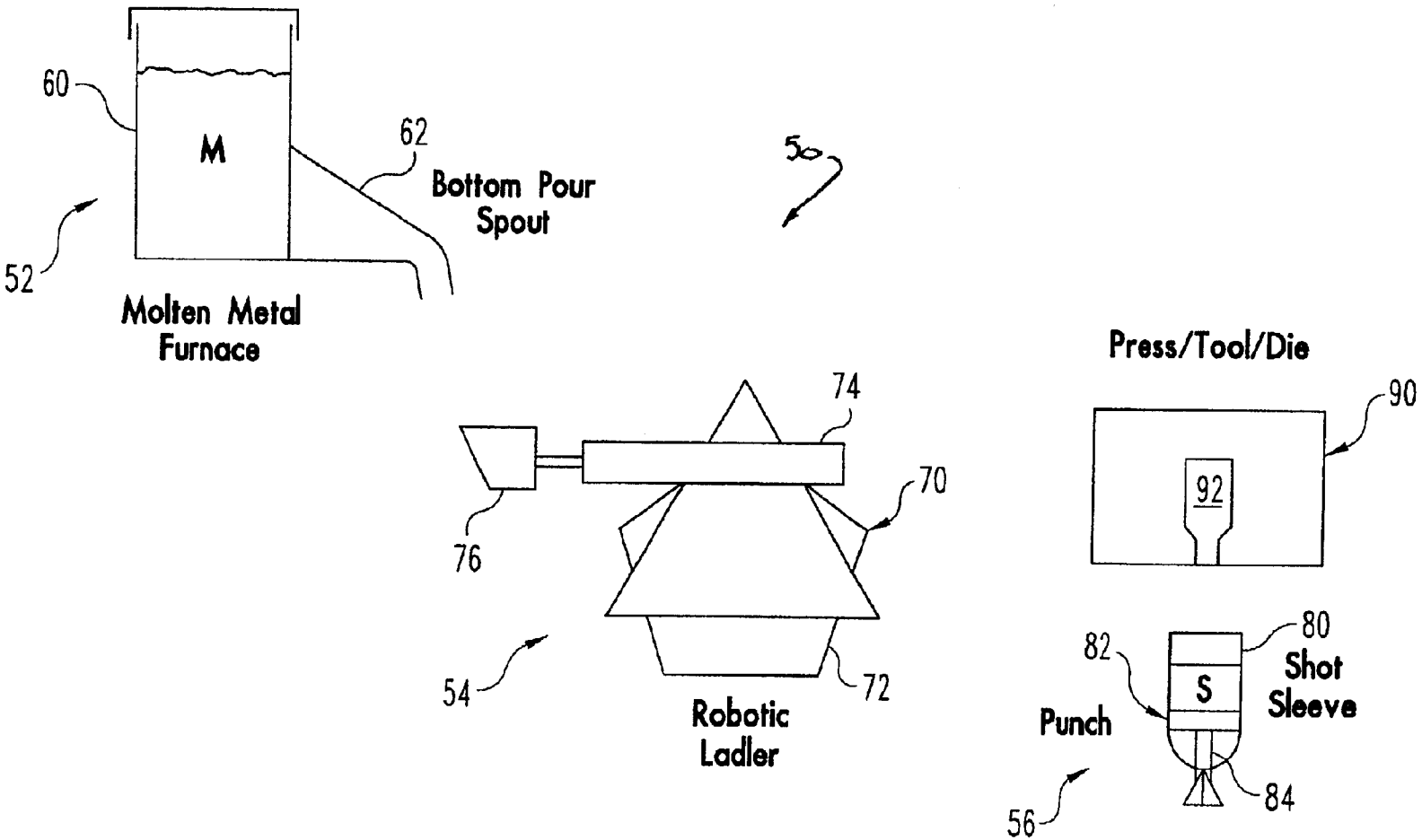
FIG. 4 is a diagrammatic process flow diagram illustrating a method and apparatus according to one form of the present invention for producing semi-solid slurry material for application in forming shaped parts.

Referring to FIG. 4, there is illustrated a method and apparatus 50 according to one form of the present invention for producing semi-solid material and forming shaped parts therefrom. The apparatus 50 generally comprises a heating station 52, a transferring station 54, and a forming station 56. As will become apparent below, the apparatus 50 is configured to produce semi-solid material "on demand", a process referred to herein as semi-solid on demand (SSOD). In the SSOD process, semi-solid material is produced in a temperature-controlled vessel and delivered to a casting device, such as a die-mold, where the semi-solid material is formed into a shaped part. The semi-solid material is also referred to as a "slurry", and the amount of slurry produced in the temperature-controlled vessel is also referred to as a "single shot" or "slurry billet".

In one form of the present invention, the heating station 52 includes a holding furnace 60 adapted to heat a metal alloy, such as, for example, an aluminum alloy, to a molten state to form a metallic melt M. In one specific embodiment, the metal alloy is A357 AlSiMg alloy. It should be understood, however, that the present invention may also be used in conjunction with other aluminum alloys and other types of metal alloys, such as magnesium alloys. The furnace 60 preferably includes a bottom pour spout 62 equipped with a gate or valve (not shown) adapted to release a select amount of the metallic melt M from the furnace 60. Although a preferred embodiment of the furnace 60 has been illustrated and described herein, it should be understood that other types and configurations of furnaces are also contemplated as being within the scope of the invention.

A select amount of the metallic melt M is transferred from the heating station 52 to the forming station 56 via the transferring station 54. In one embodiment, the transferring station 54 includes is an automatic ladler 70 having a base 72, a robotic arm 74 and a ladle 76. The robotic arm 74 positions the ladle 76 beneath the bottom pour spout 62 and a select amount of metallic melt M is transferred thereto. The robotic arm 74 thereafter repositions the ladle 76 and transfers the metallic melt M to the forming station 56. Although a preferred embodiment of the transfer station 54 has been illustrated and described herein, it should be understood that other types and configurations of transfer mechanisms are also contemplated as being within the scope of the invention. For example, the transfer station 54 could alternatively include one or more crucibles transportable between the heating and forming stations 52, 56 by way of a robotic arm or a rotating turntable. It should also be understood that the metallic melt M may alternatively be transferred directly from the furnace 60 to the forming station 56 via the bottom pour spout 62, without the use of an intermediate ladle or crucible.

Once transferred to the forming station 56, the metallic melt M is cooled at a controlled rate within a temperature-controlled forming vessel 80 to effect partial solidification of the metallic melt M to produce a semi-solid slurry material S. Such partial solidification is accomplished without stirring or imparting any other form of agitation to the metallic melt M. In one embodiment, the temperature-controlled vessel 80 is the shot sleeve of a semi-solid forming press 82. The forming press 82 includes an injector ram or punch 84 configured to inject the semi-solid slurry material S under pressure directly into a die mold 90 to form a shaped part. The die mold 90 includes a die cavity 92 corresponding to the shape of the part. Although the shot sleeve 80 is illustrated in a vertical orientation with injector ram 84 operating in an up-down direction, it should be understood that the shot sleeve 80 may alternatively be arranged in a horizontal orientation with the injector ram 84 operating in a side-to-side direction.

Having introduced the primary components of the apparatus 50, reference will now be made to various process steps and parameters associated with producing the semi-solid slurry material S and forming the semi-solid slurry material S into a shaped part. As discussed above, the metal alloy is initially heated by the furnace 60 to form a metallic melt M. Preferably, the metal alloy is heated to a temperature no greater than 40 degrees Celsius above the liquidus temperature of the alloy to form the metallic melt M. As also discussed above, an amount of the metallic melt M is transferred into the temperature-controlled vessel 80, either by way of the automatic ladler 70, an intermediate crucible, or directly from the furnace 60 via the pour spout 62.

In one form of the invention, nucleation of the metallic melt M is effected by regulating various parameters associated with the transfer of the metallic melt M into the temperature-controlled vessel 80. Specifically, nucleation of the metallic melt M may be effected by regulating one of more of the following parameters: 1.) the temperature of the metallic melt held within the furnace, 2.) the temperature of the metallic melt while being poured into the vessel, 3.) the vessel temperature, 4.) the rate of transfer of the metallic melt into the vessel, 5.) the amount of metallic melt transferred into the vessel, and/or 6.) the temperature of the metallic melt at the completion of the pouring. In one embodiment, at least the pour temperature of the metallic melt is regulated to at least partially effect nucleation. In another embodiment, nucleation is at least partially effected by regulating the difference between the hold temperature of metallic melt and the pour temperature of the metallic melt. In a further embodiment, nucleation is at least partially effected by regulating the temperature drop of the metallic melt during the pouring.

In one embodiment, the pour temperature of the metallic melt is between the coherency temperature of the metal alloy and about 25 degrees Celsius above the liquidus temperature of the metal alloy. In a more specific embodiment, the pour temperature is between about 3 degrees Celsius above the liquidus temperature and about 15 degrees Celsius above the liquidus temperature. In a still more specific embodiment, the pour temperature is between about 5 degrees Celsius above the liquidus temperature and about 10 degrees Celsius above the liquidus temperature. As used herein, the term "liquidus temperature" is the temperature at which a metal alloy becomes a liquid, and the term "coherency temperature" is the point at which the viscosity of the semi-solid slurry increases markedly and the slurry becomes thixotropic.

The metallic melt M may be cooled to the desired pour temperature by uncontrolled convective heat transfer to the ambient environment, or may alternatively be cooled by regulating the removal and/or addition of heat to the metallic melt M by way of an intermediate holding station. Such intermediate holding station may be in the form of a holding vessel, such as, for example, the ladle 76 or another type of crucible. Control over the removal and/or addition of heat may be accomplished, for example, by passing a heat transfer media, such as oil, through passages in the intermediate holding vessel and/or by adding heat to the metallic melt by way of a heating device, such as, for example, an induction heater. The temperature and cooling rate of the metallic melt within the intermediate holding vessel may also be controlled to effect partial solidification of the metallic melt and/or particle morphology prior to delivery of the metallic melt to the temperature-controlled vessel 80. Once the desired intermediate state is reached, the metallic melt M is transferred to temperature-controlled vessel 80 to complete the formation of the semi-solid slurry S.

The temperature of the metallic melt being transferred from the intermediate holding vessel to the vessel 80 preferably falls within a temperature range below the alloy liquidus temperature but above the coherency temperature (e.g., about 606 degrees Celsius to about 610 degrees Celsius for aluminum alloys A356 and A357). In this particular embodiment, the metallic melt behaves as a Newtonian fluid during transfer to the vessel 80, where shear rate is proportional to shear stress. In such cases, the metallic melt may be discharged from the intermediate holding vessel by a simple tilt pour, where the intermediate holding vessel is tilted to allow the metallic melt to flow therefrom into the temperature-controlled vessel 80.

In another embodiment, the temperature of the metallic melt being transferred from the intermediate holding vessel to the vessel 80 is at or below the point of coherency (e.g., at about 606 degrees Celsius for aluminum alloys A356 and A357). In this embodiment, the metallic melt has a relatively high fraction solid (e.g., greater the 0.25 at temperatures below 604 degrees Celsius) and behaves as a Bingham fluid during transfer to the vessel 80, where the relationship between shear rate and shear stress is non-linear. In such cases, the intermediate holding vessel is preferably of the bottom discharge type, where the metallic melt is gravity fed through an opening in the bottom of the vessel and into the temperature-controlled vessel 80.

The temperature of the forming vessel 80 during the transfer of the metallic melt M thereto is preferably between about 606 degrees Celsius and about 610 degrees Celsius. In another embodiment, the selected rate of transfer of the metallic melt M into the forming vessel 80 is between about 0.01 pounds per second and about 1.0 pounds per second. In a more specific embodiment, the selected rate of transfer is about 0.50 pounds per second. In still another embodiment, the amount of metallic melt transferred to the forming vessel 80 is between about 0.50 pounds and about 10 pounds.

Following the transfer of a select amount of metallic melt M into the forming vessel 80, crystallization of the metallic melt M is effected by cooling the melt at a controlled rate to form the semi-solid material S. The cooling rate of the melt is tightly controlled to achieve a temperature below the liquidus temperature of the alloy but above the eutectic temperature. As used herein, the term "eutectic temperature" refers to the lowest possible liquidus temperature prior to complete solidification of the alloy. In one embodiment, the cooling rate of the metallic melt M within vessel 80 is controlled within a range of about 0.01 degrees Celsius per second to about 5.0 degrees Celsius per second. In a more specific embodiment, the cooling rate of the metallic melt M within vessel 80 is controlled within a range of about 0.01 degrees Celsius per second to about 1.0 degrees Celsius per second.

It should be understood that selection of the appropriate cooling rate depends upon the specific composition of the metallic alloy and the desired material characteristics and particle morphology of the semi-solid slurry. It should also be understood that the cooling rate can be robustly controlled in order to meet a wide range of processing requirements involving different alloys, shot sizes, cycle times and delivery temperatures. As used herein, the term "robustly" is intended to encompass the capability of using substantially the same technique to process a wide range of alloys and to produce a wide range of parts with the same degree of control and precision in the final composition of the slurry and in part quality. It should further be understood that although controlling the cooling rate of the metallic melt M is vital to crystallization of the metallic melt, crystallization may also be at least partially effected by regulating the parameters discussed above regarding nucleation of the metallic melt.

By controlling the cooling rate and the residence time/temperature of the metallic melt within the forming vessel 80, a semi-solid slurry S is developed having a desired alpha particle size and shape and a desired material viscosity. Apparent viscosities of the semi-solid slurry below 200 poise are preferred. Unlike previous methods of producing semi-solid material, the present invention does not require that the metallic melt be stirred or otherwise agitated during the solidification process. Additionally, the present invention does not require the addition of grain refiners to initiate and control nucleation and crystallization of the metallic melt. Instead, the desired microstructure of the semi-solid slurry is achieved by tightly controlling the cooling rate of the metallic melt during solidification. If the cooling rate of the molten alloy is sufficiently slow at the point of coherency, the arms of the dendritic particles begin to coalesce at points of contact in the growth process and the dendrites begin to divide into rounded, partially dendritic primary particles dispersed in a liquid matrix.

Figure 5:
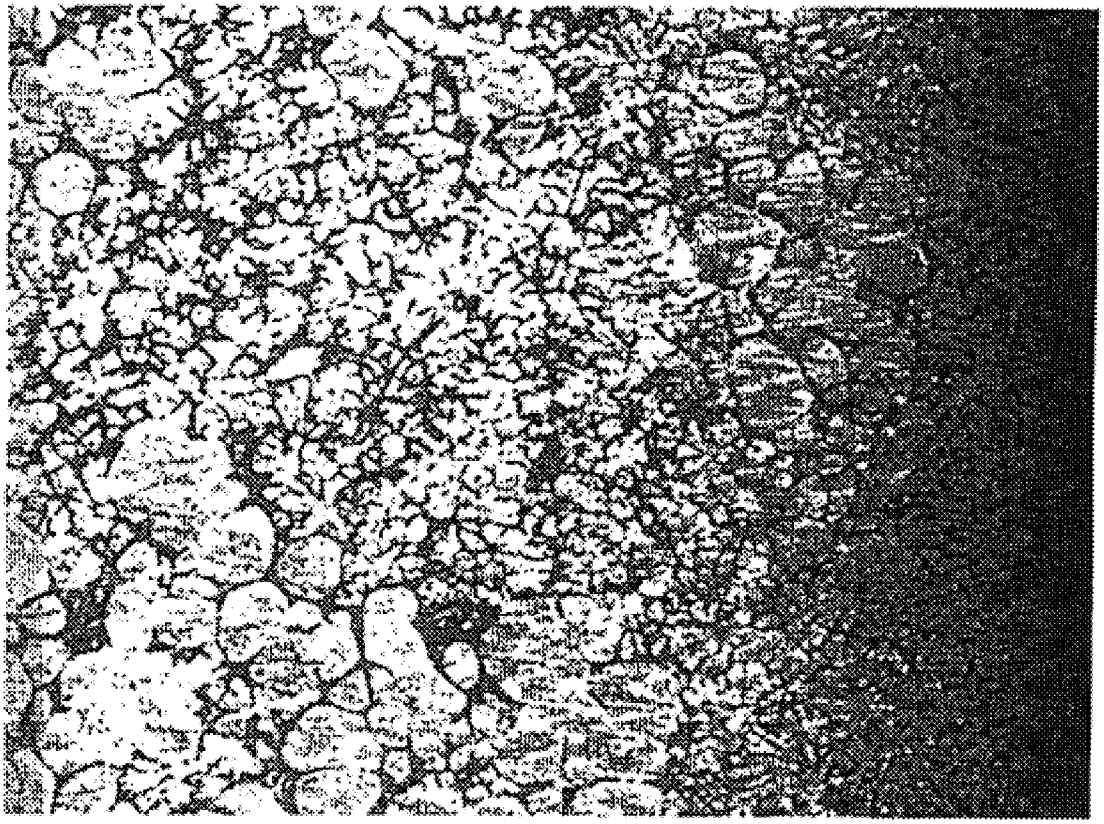
FIG. 5 is a photomicrograph at a magnification of 100×, illustrating an intermediate stage of semi-solid slurry formation.

During the initial stages of semi-solid slurry development, fine primary dendritic particles begin to form. Referring to FIG. 5, illustrated therein is an intermediate stage of semi-solid slurry development, showing the growth and clustering of coarse primary, partially dendritic particles in a matrix of fine secondary dendrites and eutectic material. This formation process is driven by capillary forces resulting from the energy reduction associated with minimization of surface area of the primary solid particles. The surface area reduction of the solid particles also causes rounding and clustering of the solid particles. The clusters of rounded particles continue to grow in size and roundness until a eutectic reaction begins when the semi-solid material reaches its eutectic temperature (about 577 degrees Celsius for aluminum alloys A356 and A357). This eutectic reaction normally occurs at about 0.50 solid fraction content.

Figure 6:
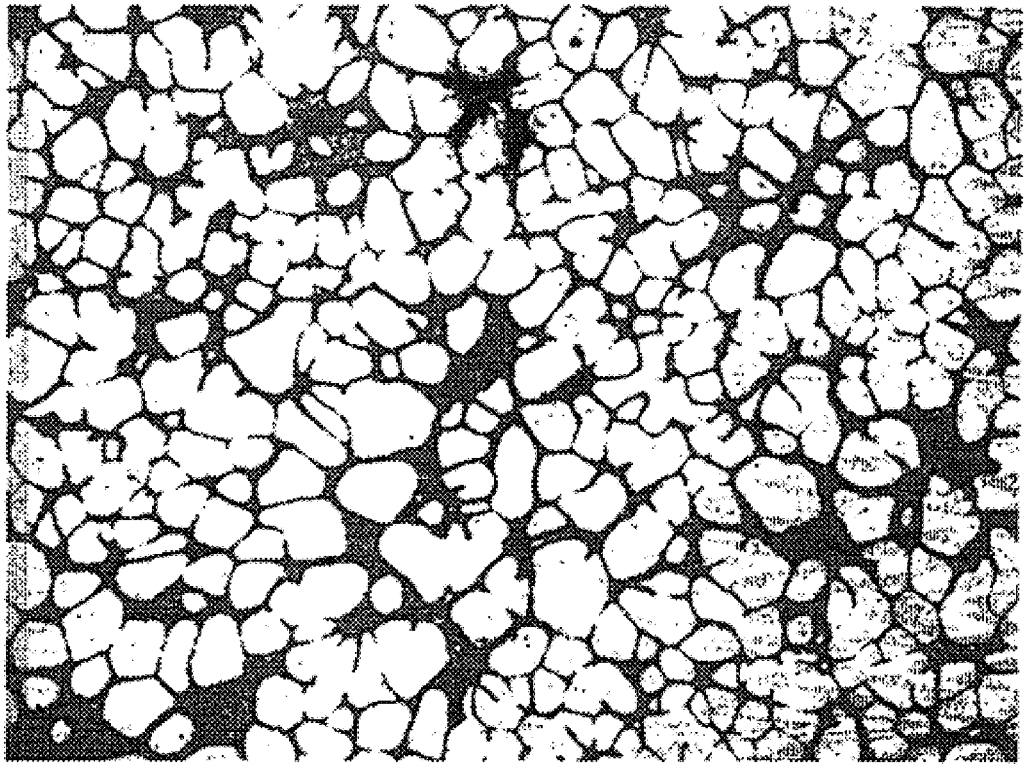
FIG. 6 is a photomicrograph at a magnification of 100×, illustrating a final stage of semi-solid slurry formation.

Referring to FIG. 6, shown therein is a final stage of semi-solid slurry development, where the semi-solid material has a microstructure comprising solid, equiaxed, rounded particles dispersed in a liquid metal matrix. In one embodiment, the rounded primary particles have a globular or spherical configuration. In a specific embodiment, the rounded primary particles have a diameter in a range between about 40 $\mu$m and about 150 $\mu$m. In a more specific embodiment, the rounded primary particles have a diameter in a range between about 40 $\mu$m and about 50 $\mu$m.

Figure 7:
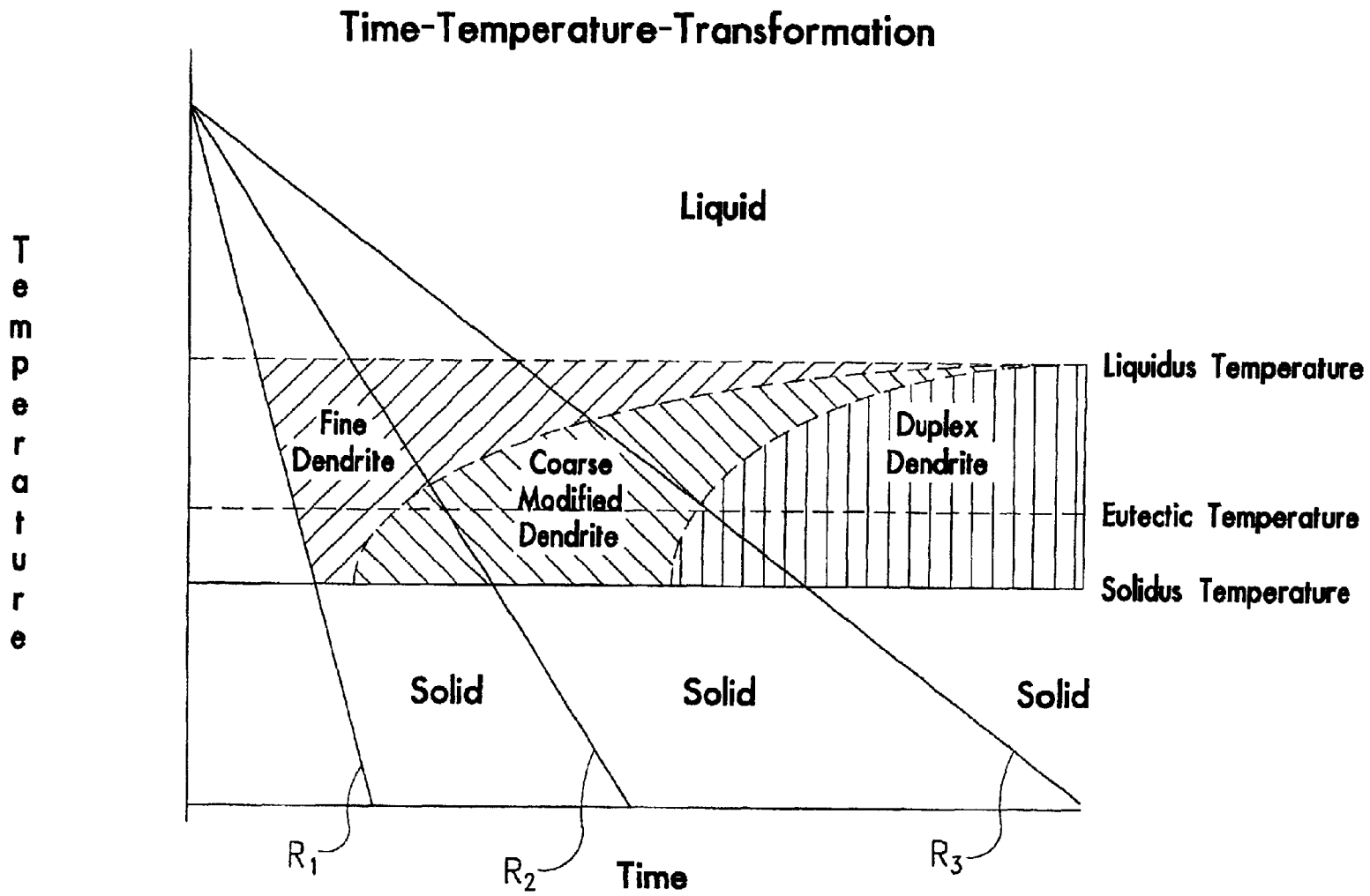
FIG. 7 is a time-temperature-transformation model illustrating primary particle morphology as a function of cooling rate.

Referring to FIG. 7, shown therein is a qualitative portrayal of a time-temperature-transformation model of the solidification process, illustrating the resulting primary particle morphology of the semi-solid material as a function of cooling rate. More specifically, FIG. 7 illustrates changes in the microstructure of primary particles which result from varying the cooling rate of the metallic melt during the solidification process. At relatively high cooling rates, such as that illustrated by cooling rate line $R_1$, fine dendritic particles are formed in the semi-solid material as the metallic material begins to solidify. However, at relatively lower cooling rates, such as that illustrated by cooling rate line $R_2$, fine dendritic particles are formed during the initial stage of semi-solid slurry development, followed by the ultimate formation of coarse, partially dendritic particles during the later stages of semi-solid slurry development. At still lower cooling rates, such as that illustrated by cooling rate line $R_3$, fine dendritic particles and coarse, partially dendritic particles are formed during the initial stages of semi-solid slurry development, followed by the ultimate formation of duplex dendritic particles during the later stages of semi-solid slurry development. In a preferred embodiment of the present invention, the cooling rate of the metallic melt falls generally along the cooling rate line $R_3$. As discussed above, the cooling rate of the metallic melt preferably falls within a range of about 0.01 degrees Celsius per second to about 5.0 degrees Celsius per second, and more preferably falls within a range of about 0.01 degrees Celsius per second to about 1.0 degrees Celsius per second. Under these controlled cooling conditions, a preferred semi-solid material is produced having a microstructure comprising rounded solid particles dispersed in a liquid metal matrix.

Figure 8:
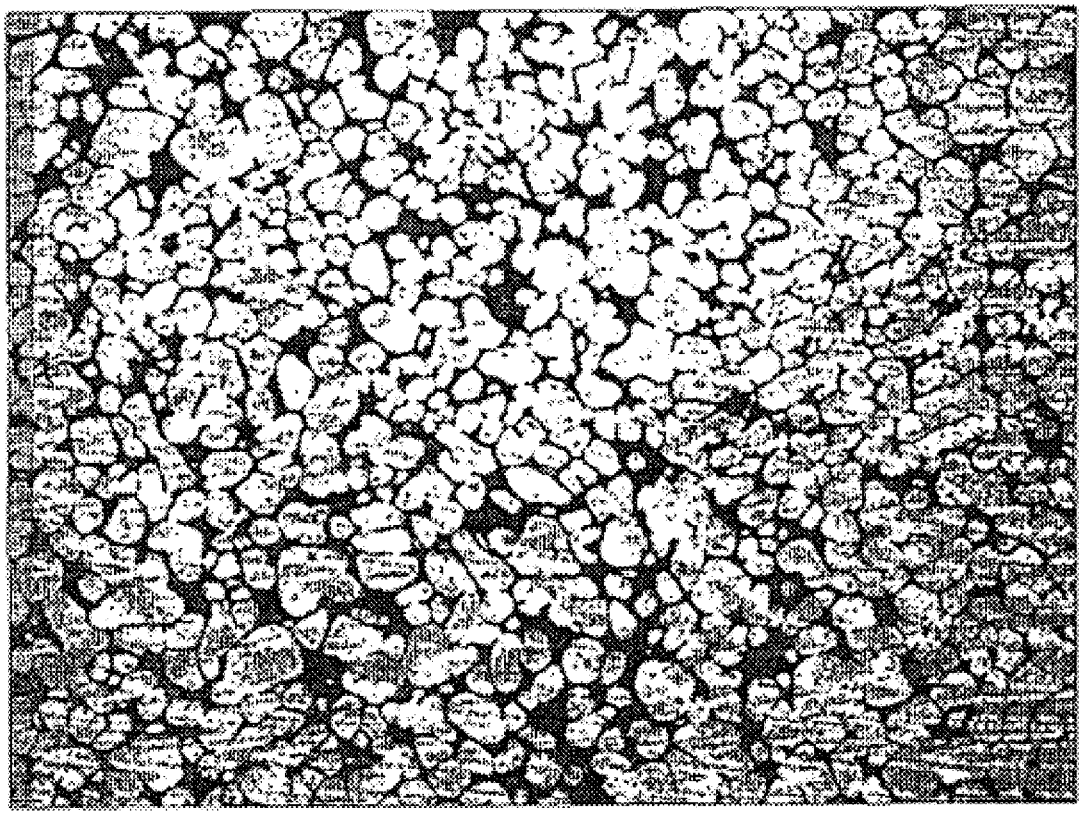
FIG. 8 is a photomicrograph at a magnification of 100×, illustrating a semi-solid formed shaped part.

When the desired fraction solid, particle size/shape, and particle morphology have been attained, the semi-solid slurry material is injected into a die-mold or some other type of forming device. Final solidification of the semi-solid material then commences wherein the remaining liquid fraction is reduced, thereby resulting in the formation of a dense, near-net-shape part. A "near-net-shape part" is generally defined as a part having an as-formed geometric shape (i.e., without machining) that closely approximates a desired geometric part shape. The microstructure of a shaped part formed using the above-discussed process is illustrated in FIG. 8. Notably, the final microstructure of the solidified part is very similar to that of semi-solid material in the final stages of slurry development (as shown in FIG. 6). Specifically, the solidified part includes a primary particle morphology that closely corresponds to the primary particle morphology of the semi-solid slurry material. As a result, part shrinkage and material defects are minimized. Additionally, silicon particle size in the solidified part is minimized by injecting the semi-solid slurry material S directly into the die mold prior to appreciable eutectic reaction. Rapid cooling of the remaining eutectic liquid within the die mold results in fine silicon particle dispersion.

A part formed according to the present invention will typically have equivalent or superior mechanical properties, particularly the property of elongation, as compared to parts formed by prior casting processes. Examples of the mechanical properties of a representative part formed of an aluminum alloy A357 are set forth below in Table A.

TABLE A

| | As Formed | T5 Hardened | T6 Hardened |
|---|---|---|---|
| Ultimate Tensile Strength | 16.0–20.0 ksi | 35.0–40.0 ksi | 44.0–47.0 ksi |
| Yield Strength | 13.0–16.0 ksi | 27.0–30.0 ksi | 36.0–40.0 ksi |
| Elongation | 8–13% | 8–13% | 8–13% |

Figure 9:
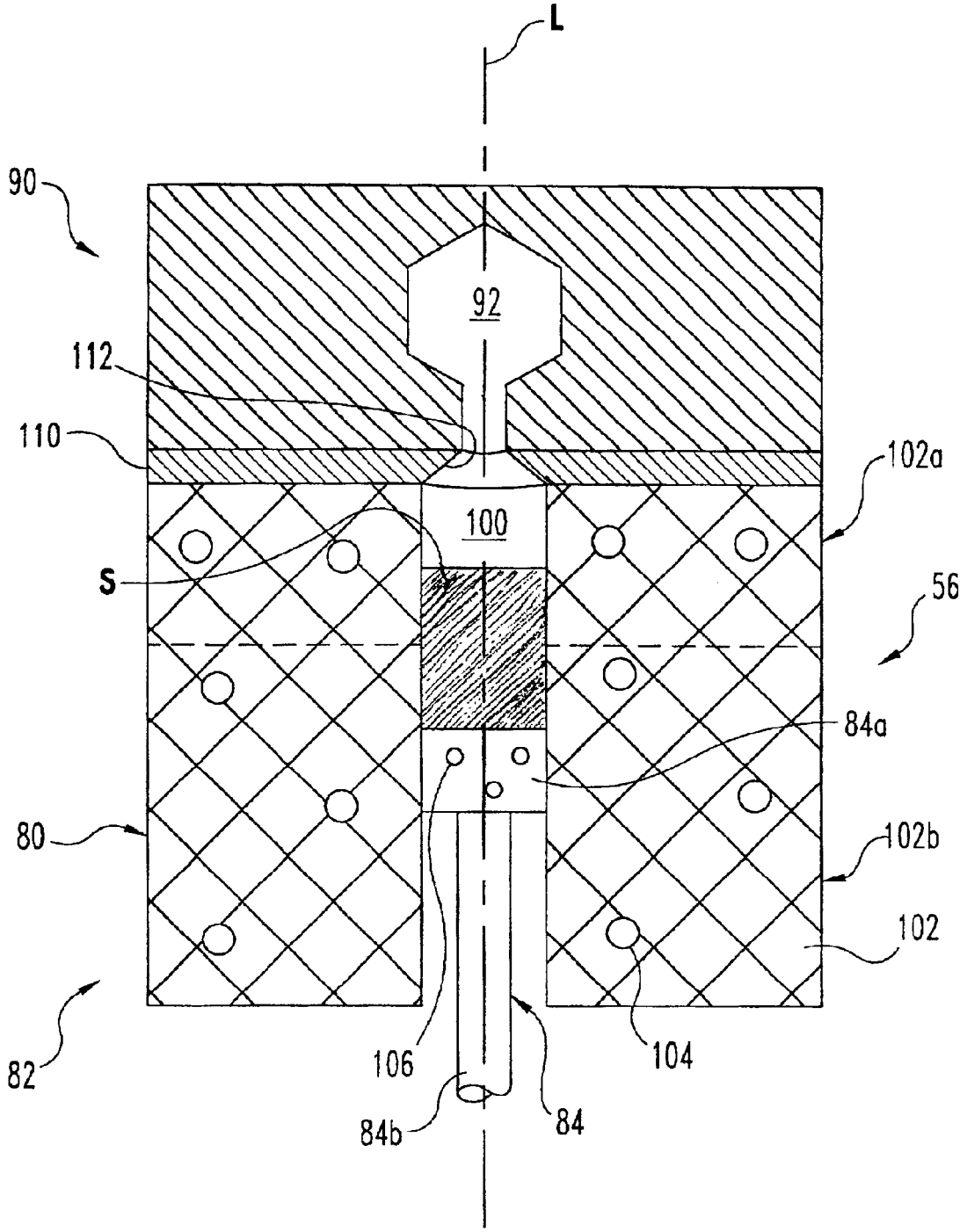
FIG. 9 is a partial cross-sectional view of a temperature-controlled shot sleeve and die mold according to one embodiment of the present invention.

Referring now to FIG. 9, there are shown additional features of the forming station 56 used in the production of semi-solid slurry material and the formation of shaped parts therefrom. As discussed above, the forming station 56 includes a temperature-controlled vessel 80 adapted to control the temperature and cooling rate of metallic melt M contained therein to produce the semi-solid slurry material S. In one form of the invention, the temperature-controlled vessel 80 is the shot sleeve of a semi-solid forming press 82. The press 82 includes an injector ram or plunger 84 configured to inject the semi-solid slurry S material under pressure directly into the cavity 92 of die mold 90 to form the shaped part.

In one embodiment, the temperature-controlled vessel 80 and the injector ram 84 are formed of stainless steel. However, other materials, such as, for example, graphites and ceramics are also contemplated. Some of the more important material properties of the temperature-controlled vessel 80 and ram 84 include relatively high strength at high temperatures, good corrosion resistance and a relatively high degree of thermal conductivity. To provide resistance to attack by reactive alloys, such as molten aluminum, and also to aid in discharging the semi-solid slurry after the forming process is completed, the inside surfaces of vessel 80 and ram 84 are preferably coated or thermally sprayed with boron nitride, a ceramic coating, or any other suitable material. Because the temperature-controlled vessel 80 must absorb heat from the metallic melt and dissipate the heat to the surrounding environment, low thermal resistance is a particularly important factor in the selection of a suitable vessel material. Additionally, material density and thickness must also be considered.

The temperature-controlled vessel 80 includes an inner passage 100 for receiving a select amount of the metallic melt M. As discussed above, the vessel 80 is adapted to cool the metallic melt M at a controlled rate. To provide such control over the cooling rate of the metallic melt, the vessel 80 includes a temperature-controlled sidewall 102 extending along a longitudinal axis L. In one embodiment, the sidewall 102 has a cylindrical shape; however, other shapes and configurations of sidewall 102 are also contemplated. For example, sidewall 102 could alternatively be shaped as a square, polygon, ellipse, or any other shape as would occur to one of ordinary skill in the art.

Sidewall 102 defines a number of passageways 104 adapted to carry a heat transfer media to effectuate heat transfer between sidewall 102 and the metallic melt M contained within passage 100. In one embodiment of the invention, the heat transfer media is oil. However, it should be understood that other types of fluids, such as, for example, air or water, are also contemplated. Additionally, although cooling passageways 104 are illustrated as extending in a circumferential direction about longitudinal axis L, it should be understood that other configurations are also contemplated. For example, in an alternative embodiment, passageways 104 may be configured to extend in an axial or radial direction. It should also be understood that passageways 104 may be comprised of a number of individual passageways extending annularly through sidewall 102, or may alternatively be comprised of a continuous passageway extending helically through sidewall 102.

In one embodiment of vessel 80, sidewall 102 includes a plurality of heat transfer zones. As illustrated in FIG. 9, sidewall 102 includes two heat transfer zones extending along longitudinal axis L. Specifically, a first axial portion 102*a* of sidewall 102 defines a first heat transfer zone and a second axial portion 102*b* of sidewall 102 defines a second heat transfer zone. Preferably, each heat transfer zone is individually controlled to provide independent control over the temperature of the metallic melt disposed adjacent each respective axial sidewall portion 102*a*, 102*b*. In one embodiment, the first axial portion 102*a* extends along approximately one-third of sidewall 102, with the second axial portion 102*b* extending along the remaining two-thirds of sidewall 102. It should be understood, however, that sidewall 102 may include any number of heat transfer zones extending along various axial portions thereof.

In another embodiment of the invention, the piston portion 84*a* of ram 84 defines a third heat transfer zone. Specifically, piston portion 84*a* includes a number of passageways 106 adapted to carry a heat transfer media to effectuate heat transfer between piston portion 84*a* and the metallic melt contained within passage 100. As discussed above, the heat transfer media may be comprised of air, oil, water or any other suitable fluid. Similar to passageways 104, cooling passageways 106 may extend through piston portion 84*a* in a circumferential, radial or axial direction. In one embodiment, the heat transfer media is supplied to passageways 106 by a bore (not shown) extending axially through the rod portion 84*b* of ram 84.

In a preferred embodiment of the invention, separate temperature-controlled oil reservoir units (not shown) are provided to individually control the temperature of the oil circulating through each of the heat transfer circuits defined by vessel 80 and ram 84. Individually controlling and adjusting the temperature of the oil circulating through each heat transfer circuit provides increased control over the cooling rate of the metallic melt M. An automatic feedback loop is preferably provided which measures the temperature at each heat transfer zone and correspondingly adjusts the temperature of the oil circulating through each of the heat transfer circuits.

Once the microstructure of the semi-solid slurry S has been modified to the proper morphology, the injector ram or plunger 84 is displaceable along the inner passage 100 of shot sleeve 80 to inject the semi-solid slurry S material under pressure directly into the die-mold 90. Since the semi-solid slurry S is fed directly into the die-mold 90, precise control over the injection temperature and other metallurgical parameters is possible, thereby ensuring that the desired characteristics of the semi-solid slurry are maintained. Additionally, since the semi-solid slurry S is formed within the shot sleeve 80, and not within an intermediate forming vessel, material scrap rates are also reduced.

In one form of the present invention, the rate of displacement of the ram 84 is controlled to maintain a sufficiently low fill velocity to provide non-turbulent flow of the semi-solid slurry S into the die mold 90. In one embodiment, the rate of displacement of the ram 84 is between about 1 inch per second and about 50 inches per second to provide laminar flow of the semi-solid material S into the die mold 90. In a more specific embodiment, the rate of displacement of the ram 84 is between about 1 inch per second and about 10 inches per second. In another form of the invention, the fluid viscosity of the semi-solid slurry S is regulated to provide additional control over the flow characteristics of the semi-solid slurry S as the slurry is injected into the die mold 90. In one embodiment, the fluid viscosity of the semi-solid slurry S is regulated by adjusting the temperature of the slurry material by way of the temperature-controlled shot sleeve 80.

In yet another form of the present invention, a gate 110 is provided between the shot sleeve 80 and the die mold 90 to provide additional control over the flow characteristics of the semi-solid slurry S as the slurry is injected into the die mold 90. The gate 110 includes an aperture 112 positioned in communication between the inner passage 100 of shot sleeve 80 and the die cavity 92 of die mold 90. The aperture 112 is sized and configured to regulate the flow of the semi-solid slurry S into the die mold 90 during displacement of the ram 84. In one embodiment, the aperture 112 is generally circular and is inwardly tapered in the direction of material flow so as to define a conical shape. However, it should be understood that other shapes and configurations of gate 110 and aperture 112 are also contemplated as being within the scope of the invention. It should also be understood that the gate 110 and aperture 112 are preferably designed to avoid restricting the flow of the semi-solid slurry S to such a degree so as to cause the build up of back pressure during the die-fill process.

Several methods have been disclosed for providing laminar flow of the semi-solid slurry S into the die mold 90, including controlling the rate of displacement of the ram 84, regulating the viscosity of the semi-solid slurry S, and providing a gate 110 between the shot sleeve 80 and the die mold 90. However, it should be understood that any combination of these methods may be used to provide laminar flow of the semi-solid slurry S into the die mold 90, including the individual use of any of the above-discussed methods.

In one form of the present invention, the flow of the semi-solid slurry S is regulated such that the Reynolds number associated with the flow is about 200 or less. The Reynolds number criterion is useful in the selection of a suitable rate of displacement of the ram 84, a suitable viscosity of the semi-solid slurry S, and/or a suitable size and configuration of the aperture 112 in gate 110. For round apertures 112, the Reynolds number may be calculated by applying the following formula:

$$R_e = D*V*\eta/\rho;$$

wherein D is the diameter of the aperture 112 in gate 110, V is the velocity of the semi-solid slurry passing through aperture 112, $\rho$ is the density of the semi-solid slurry, and $\eta$ is the fluid viscosity of the semi-solid slurry.

However, as should be apparent to one of ordinary skill in the art, the above-described formula may be modified to accommodate other shapes and configurations of aperture 112.

Figure 10:
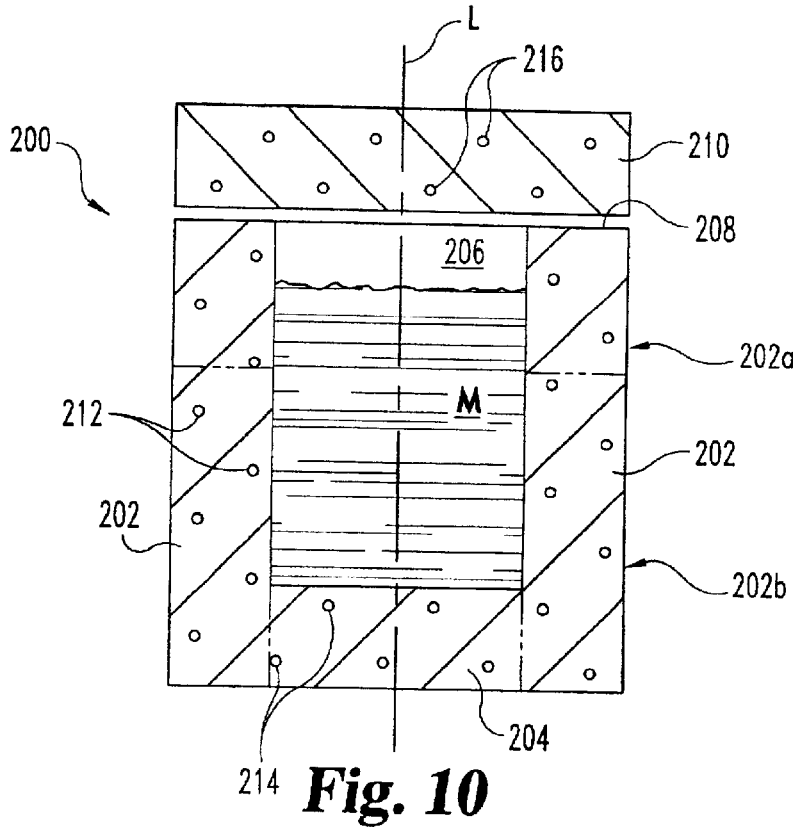
FIG. 10 is a partial cross-sectional view of a temperature-controlled vessel according to another embodiment of the present invention.

Referring now to FIG. 10, shown therein is another embodiment of a temperature-controlled vessel 200 adapted for use with the present invention. The temperature-controlled vessel 200 extends along a longitudinal axis L and includes a sidewall 202 and a bottom end wall 204 cooperating to define an inner passage 206. The inner passage 206 opens onto a top end 208 of side wall 202 to allow vessel 200 to be charged with a select amount of metallic melt M and to allow the semi-solid slurry S to be discharge therefrom. An end cap 210 is preferably positioned adjacent the open top 208 after the vessel 200 is charged with the metallic melt.

Sidewall 202 is configured similar to sidewall 102 of vessel 80, and includes a number of passageways 212 adapted to carry a heat transfer media to effectuate heat transfer between sidewall 202 and the metallic melt M contained within passage 206. Additionally, the bottom end wall 204 is preferably configured similar to piston portion 84*a* of ram 84, with the exception that end wall 204 remains stationary relative to sidewall 202. End wall 204 includes a number of passageways 214 adapted to carry a heat transfer media to effectuate heat transfer between end wall 204 and the metallic melt M contained within passage 206. End cap 210 also preferably includes a plurality of passageways 216 adapted to carry a heat transfer media to effectuate heat transfer between end cap 210 and the metallic melt M contained within passage 206.

It should be understood that any of the features associated with vessel 80 may be incorporated into the design of vessel 200. For example, sidewall 202 of vessel 200 may be designed to include a plurality of heat transfer zones. Specifically, sidewall 202 may include two or more heat transfer zones extending along longitudinal axis L, with a first axial portion 202*a* of sidewall 202 defining a first heat transfer zone and a second axial portion 202*b* of sidewall 202 defining a second heat transfer zone. Each heat transfer zone is preferably individually controlled to provide independent control over the temperature of the metallic melt disposed adjacent the respective axial sidewall portions 202*a*, 202*b*. The heat transfer zones defined by end wall 204 and end cap 210 are also preferably individually controlled to provide independent control over the temperature of the metallic melt disposed adjacent end wall 204 and end cap 210.

It should be appreciated that since vessel 200 is equipped with a number of individually controlled heat transfer zones, more precise control over the cooling rate of the metallic melt is possible, which in turn has a tendency to increase control over the particle morphology of the semi-solid material. It should also be appreciated that since inner passage 206 is completely surrounded by multiple heat transfer zones (i.e., sidewall portions 202*a*, 202*b*, end wall 204 and end cap 206), vessel 200 is capable of providing control over the rate of heat transfer from the metallic melt M in all directions. Such multi-directional control over the heat transfer rate has the effect of providing a more uniform temperature distribution throughout the semi-solid slurry billet, which in turn results in a more uniform microstructure.

Since the temperature-controlled vessel 200 is not an integral part of the semi-solid forming press, means must be provided for discharging the semi-solid material into the shot sleeve of a forming press. Such means may include, for example, a robotic arm adapted to transfer vessel 200 between charging and discharging locations. Alternatively, the temperature-controlled vessel 200 may be incorporated into the transfer station 54 in place of the ladle 76. In this embodiment, a select amount of the metallic melt M may be charged directly into the temperature-controlled vessel 200 from furnace 60, with the bottom pour spout 62 or another similar structure being used to regulate the transfer of the metallic melt M to vessel 200.

Figure 11:
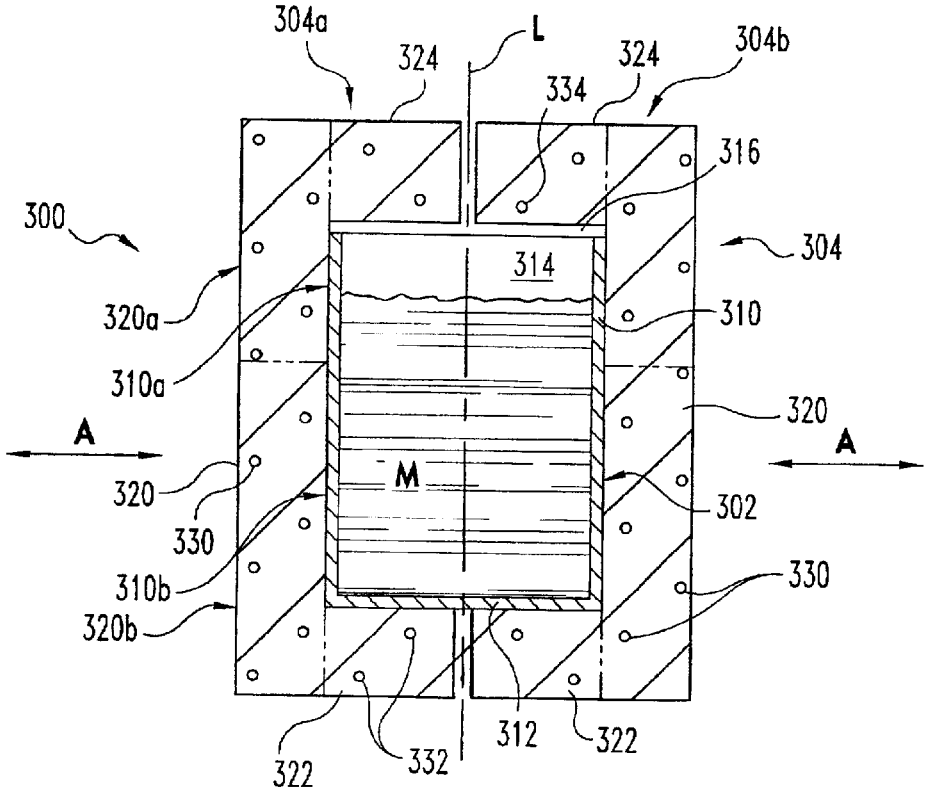
FIG. 11 is a partial cross-sectional view of a temperature-controlled vessel according to another embodiment of the present invention, including an inner containment vessel and an outer thermal jacket.

Referring now to FIG. 11, shown therein is another embodiment of a temperature-controlled vessel 300 adapted for use with the present invention. In this embodiment, the temperature-controlled vessel 300 is comprised of an inner containment vessel 302 and an outer thermal jacket 304, each extending along a longitudinal axis L. The containment vessel 302 is adapted to received a select amount of metallic melt M therein, and the thermal jacket 304 is adapted to effectuate heat transfer between containment vessel 302 and the metallic melt contained therein.

The inner containment vessel 302 includes a sidewall 310 and a bottom end wall 312 cooperating to define an inner passage 314. The inner passage 314 opens onto a top end 316 to allow vessel 302 to be charged with a select amount of metallic melt M and to allow the semi-solid slurry S to be discharged therefrom. The containment vessel 302 preferably has a substantially cylindrical configuration; however, other configurations are also contemplated as would occur to one of ordinary skill in the art.

The thermal jacket 304 includes two generally symmetrical longitudinal halves 304*a*, 304*b*, each including a sidewall portion 320, a bottom end wall portion 322, and a top end wall portion 324. Each longitudinal half 304*a*, 304*b* has a substantially semi-cylindrical shape. The sidewall portions 320 are configured substantially complementary to sidewall 310 of vessel 302. The bottom end wall portions 322 are configured substantially complementary to the bottom end wall 312 of vessel 302. The top end wall portions 324 are configured substantially complementary to the open top end 316 of vessel 302. It should be understood, however, that other shapes and configurations of thermal jacket 304 are also contemplated as would occur to one of ordinary skill in the art.

The thermal jacket 304 is preferably made of a material having high thermal conductivity and relatively high strength. Because the primary purpose of thermal jacket 304 is to facilitate heat transfer, thermal conductivity is a particularly important factor in the selection of a suitable thermal jacket material. Additionally, because the heating/cooling capability of thermal jacket 304 is influenced by material density, specific heat and thickness, consideration must be given to these factors as well. By way of example, thermal jacket 304 may be made of materials including, but not limited to, bronze, copper, aluminum, or stainless steel.

In order to provide sufficient control over the cooling rate of the metallic melt contained within vessel 302, thermal jacket 304 preferably includes a plurality of heat transfer sections. Sidewall portions 320 of thermal jacket 304 each preferably define first and second heat transfer sections 320*a*, 320*b* adapted to control the temperature of the metallic melt disposed adjacent first and second axial sidewall portions 310*a*, 310*b* of containment vessel 302, respectively. The bottom end wall portions 322 of thermal jacket 304 preferably define a third heat transfer section adapted to control the temperature of the metallic melt disposed adjacent the bottom end wall 312 of containment vessel 302. The top end wall portions 324 of thermal jacket 304 preferably define a forth heat transfer section adapted to control the temperature of the metallic melt disposed adjacent the open top end 316 of containment vessel 302. As described above with regard to vessels 80, 200, the heat transfer sections of thermal jacket 304 may be individually controlled to provide independent control over the temperature of the metallic melt disposed adjacent the various portions of containment vessel 302.

Thus, as illustrated in FIG. 11, thermal jacket 304 is configured to substantially encapsulate the containment vessel 302. It should be appreciated that since vessel 302 is completely surrounded by multiple heat transfer zones, the temperature-controlled vessel 300 is capable of providing a high degree of control over the rate of heat transfer from the metallic melt M in all directions. Such multi-directional control over the heat transfer rate has the effect of providing a more uniform temperature distribution throughout the semi-solid slurry billet, which in turn results in a more uniform microstructure. However, it should be understood that other configurations of the temperature-controlled vessel 300 are also contemplated, including embodiments where the thermal jacket 304 does not include bottom end wall portions 322 and/or top end wall portions 324, and embodiments where sidewall portions 320 define a single heat transfer section.

In many respects, the thermal jacket 304 is configured similar to the temperature-controlled vessel 200. Specifically, the sidewall portions 320 include a number of passageways 330 adapted to carry a heat transfer media to effectuate heat transfer with the metallic melt M contained within inner vessel 302. Additionally, the bottom end wall portions 322 include a number of passageways 332 adapted to carry a heat transfer media to effectuate heat transfer with the metallic melt M contained within inner vessel 302. Further, the top end wall portions 324 include a number of passageways 334 adapted to carry a heat transfer media to effectuate heat transfer between top end wall portions 324 and the metallic melt M contained within inner vessel 302.

Since the thermal jacket 304 is not an integral part of the inner containment vessel 302, means must be provided for laterally displacing the thermal jacket halves 304*a*, 304*b* relative to inner vessel 302 in the direction of arrows A. Such means may include, for example, a framework (not shown) adapted to support and laterally displace the thermal jacket halves 304*a*, 304*b* toward and away from one another. One example of a framework suitable for use with thermal jacket 304 is disclosed in co-pending U.S. patent application Ser. No. 09/584,859 to Lombard et al., filed on Jun. 1, 2000 and entitled "Thermal Jacket For a Vessel". The contents of this application are expressly incorporated herein by reference.

Initially, the thermal jacket halves 304, 304*b* are spaced apart a sufficient distance to allow the inner containment vessel 302 to be charged with a select amount of metallic melt M. The thermal jacket halves 304*a*, 304*b* are then positioned in close proximity to inner containment vessel 302 to effectuate heat transfer therebetween. Preferably, at least the inner surfaces of sidewall portions 320 are placed in intimate contact with the exterior surface of inner containment vessel 302 to effectuate conductive heat transfer therebetween. After the cooling process is complete, the thermal jacket halves 304, 304*b* are once again spaced apart a sufficient distance to allow the semi-solid slurry material S to be discharged from the inner containment vessel 302.

Although the circulation of a heat transfer media, such as oil, has been illustrated and described as the primary means for controlling the cooling rate of the metallic melt contained within the temperature-controlled vessels 80, 200 and 300, other heating/cooling systems are also contemplated that could be used in place of or in addition to the systems illustrated and described above. For example, a heat transfer media such as air or water could be directed across the outer surface of the temperature-controlled vessels to effectuate convective heat transfer between the vessel and the ambient environment. Additionally, the temperature-controlled vessels could be equipped with heating elements to provide an added degree of control over the temperature and cooling rate of the metallic melt M. The concept behind the inclusion of such heating elements is that if the heat transfer rate between the metallic melt and the vessel is too high, such that the cooling rate is out of the desired range or tolerance, the heating elements may be activated to bring the cooling rate back into the desired range. The heating elements may take the form of electric cartridge heaters, infra-red resistance heating coils or other induction heating devices.

During the pouring of the metallic melt M into the temperature-controlled vessels 80, 200, 300, the initial contact of the metallic melt M with relatively cooler vessel walls may cause a solidified or partially solidified skin to form along the interior surfaces of the vessel. Generally, formation of a solidified or partially solidified skin is undesirable because portions of the skin may chip off or become dislodged and may be fed into the die mold 90 along with the semi-solid slurry material. The inclusion of such solidified chips of material within the semi-solid slurry may negatively affect the mechanical properties of the shaped part. The property of elongation may be particularly affected by the inclusion of solidified chips within the semi-solid slurry. To prevent or at least reduce the possibility of skin formation, the inner surfaces of the temperature-controlled vessel 80, 200, 300 that are in direct contact with the metallic melt M should preferably be pre-heated to a temperature sufficient to prevent or at least minimize skin formation. Such preheating may be accomplished, for example, by circulating the heat transfer media through the passageways in vessels 80, 200, 300 or by activating the heating elements described above.

EXAMPLE

The following is an example of various parameters associated with one embodiment of the present invention. It should be understood that inclusion of these specific parameters is not intended in any way to limit the scope of the present invention.

An A357 AlSiMg metal alloy is initially heated by the furnace 60 to a temperature of about 670 degrees Celsius. The ladle 76 is then charged with approximately 4.7 pounds of the metallic melt M, with a total charge time of about 11 seconds. The metallic melt M is then transferred to the forming station 56 and poured into the temperature-controlled shot sleeve 80. The average temperature of the metallic melt within ladle 76 while being transferred to the forming station 56 is about 630 degrees Celsius. The average temperature of the metallic melt during pouring into the shot sleeve 80 is about 617 degrees Celsius, with a temperature drop of approximately 5–6 degrees Celsius occurring during the pouring. The cycle time associated with transferring the metallic melt to the forming station 56 and pouring of the metallic melt M into the shot sleeve 80 is about 18 seconds, equating to an average cooling rate of about 0.7 degrees Celsius per second. The rate of pouring of the metallic melt M into the shot sleeve 80 is about 1 pound per second. The temperature of the shot sleeve 80 prior to being charged with the metallic melt M is about 300 degrees Celsius.

The cooling rate of the metallic melt M within the shot sleeve 80 is controlled within a range of about 2 degrees Celsius per second to about 0.5 degrees Celsius per second. This controlled rate of cooling transforms the metallic melt M into a semi-solid material S having a microstructure comprising rounded solid primary particles dispersed in a liquid metal matrix. Once the temperature of the semi-solid material S reaches about 585 degrees Celsius and a fraction solid of approximately 0.65 has been achieved, the semi-solid slurry material S is injected directly into the die-mold 90 by the actuating the ram 84. The rate of displacement of the ram 84 is controlled within a range of about 4.0 inches per second to about 4.6 inches per second to provide non-turbulent flow of the semi-solid material S into the die-mold 90.

Final solidification of the semi-solid material S occurs within the die-mold 90 wherein the remaining liquid fraction is reduced, thereby resulting in the formation of a dense, near-net-shape part. The final microstructure of the solidified part is similar to the microstructure of the semi-solid material S, thereby resulting in minimal part shrinkage and reduced material defects in the solidified part. Moreover, injecting the semi-solid material S into the die-mold 90 prior to appreciable eutectic reaction results in fine silicon particle dispersion. The solidified part, which in this particular example is a compressor head for an air conditioning system, has a weight of about 1695 grams to about 1715 grams, and has a microstructure comprising primary solid particles having a grain size falling within a range of about 65 to 70 $\mu$m and a particle roundness of about 60 to 62.

As set forth above, in one form of the present invention, a semi-solid slurry S may be produced at a single location within a single forming vessel 80. The semi-solid slurry S produced within vessel 80 may be directly injected into a die mold 90 to form a shaped part. This relatively simple configuration allows for a reduction in equipment and operating costs compared to prior semi-solid forming systems. Moreover, cycle times may be shortened relative to prior semi-solid forming systems. For example, the present invention is capable of forming a semi-solid shaped part within a total cycle time of about 50 to 60 seconds, with the nucleating, crystallizing and injecting steps occurring within 45 seconds, and the nucleating and crystallizing steps occurring within 30 seconds.

While the present invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A method of producing a semi-solid material without stirring, comprising:

heating a metal alloy to form a metallic melt;

regulating the transfer of an amount of the metallic melt into a temperature-controlled vessel; and crystallizing the metallic melt in the vessel by cooling the metallic melt at a controlled rate less than 0.5 degrees Celsius per second without the use of a grain refiner and without mechanical agitation at any point during the crystallizing to form a semi-solid material having a microstructure comprising rounded solid particles dispersed in a liquid metal matrix and having an average diameter no greater than about 50 μm.

2. The method of claim 1, wherein the regulating includes transferring the metallic melt into the vessel at a selected transfer temperature.

3. The method of claim 2, wherein the selected transfer temperature is between the coherency temperature of the metal alloy and about 25 degrees Celsius above the liquidus temperature of the metal alloy.

4. The method of claim 3, wherein the selected transfer temperature is between about 3 degrees Celsius above the liquidus temperature of the metal alloy and about 15 degrees Celsius above the liquidus temperature of the metal alloy.

5. The method of claim 1, wherein the regulating further includes preheating the vessel to a selected vessel temperature prior to transferring the metallic melt into the vessel.

6. The method of claim 5, wherein the selected vessel temperature is between about 606 degrees Celsius and about 610 degrees Celsius.

7. A method of producing a semi-solid material without stirring, comprising:

heating a metal alloy to form a metallic melt;

transferring a portion of the metallic melt into a temperature-controlled holding vessel;

controllably adjusting the temperature of the metallic melt in the temperature-controlled holding vessel to a selected transfer temperature;

regulating the transfer of an amount of the metallic melt from the temperature-controlled holding vessel into a temperature-controlled forming vessel; and crystallizing the metallic melt in the forming vessel by cooling the metallic melt at a controlled rate to form a semi-solid material having a microstructure comprising rounded solid particles dispersed in a liquid metal matrix.

8. The method of claim 1, wherein the regulating further includes transferring the metallic melt into the vessel at a selected rate of transfer.

9. The method of claim 8, wherein the selected rate of transfer is between about 0.01 pounds per second and about 1.0 pounds per second.

10. The method of claim 9, wherein the selected rate of transfer is about 0.50 pounds per second.

11. The method of claim 8, wherein the regulating further includes transferring a select amount of the metallic melt into the vessel.

12. The method of claim 11, wherein the select amount is between about 0.50 pounds and about 10 pounds.

13. The method of claim 1, wherein the regulating includes controlling a differential between the temperature of the metallic melt during the heating and the temperature of the metallic melt during the transferring.

14. The method of claim 13, wherein the regulating includes controlling a drop in temperature of the metallic melt during the transferring of the metallic melt into the vessel.

15. The method of claim 1, wherein the metal alloy is heated to a temperature no greater than 40 degrees Celsius above the liquidus temperature of the metal alloy to form the metallic melt.

16. The method of claim 1, wherein the rounded solid particles are partially dendritic.

17. The method of claim 1, wherein the rounded solid particles have a diameter in a range between about 40 μm and about 50 μm.

18. The method of claim 1, wherein the temperature-controlled vessel is a shot sleeve of a semi-solid forming press.

19. The method of claim 18, further comprising:

injecting the semi-solid material from the shot sleeve directly into a die mold; and forming the semi-solid material into a shaped part.

20. The method of claim 19, wherein the shot sleeve includes:

a passage for receiving the semi-solid material; and a ram displaceable along the passage; and wherein the method further comprises injecting the semi-solid material into the die mold at a controlled rate by regulating displacement of the ram along the passage.

21. A method of semi-solid forming a shaped article, comprising:

providing a metal alloy, a temperature-controlled vessel and a mold;

heating the metal alloy to form a metallic melt;

regulating the transfer of an amount of the metallic melt into the temperature-controlled vessel; and crystallizing the metallic melt in the temperature-controlled vessel by cooling the metallic melt at a controlled rate less than 0.5 degrees Celsius per second to produce a semi-solid material having a microstructure comprising rounded solid particles dispersed in a liquid metal matrix;

feeding the semi-solid material from the temperature-controlled vessel directly into the mold without transferring the semi-solid material to an intermediate container; and forming the semi-solid material into a shaped article;

wherein the vessel comprises:

a passage for receiving the metallic melt; and a ram displaceable along the passage, the feeding comprising injecting the semi-solid material directly into the mold by displacing the ram along the passage.

22. The method of claim 21, further comprising controlling the rate of displacement of the ram to provide non-turbulent flow of the semi-solid material into the mold.

23. The method of claim 22, wherein the rate of displacement of the ram is between about 1 inch per second and about 50 inches per second.

24. The method of claim 23, wherein the rate of displacement of the ram is between about 1 inch per second and about 10 inches per second.

25. The method of claim 21, wherein performance of the transferring, nucleating, crystallizing and feeding occur within a total cycle time of less than 60 seconds.

26. The method of claim 21, wherein performance of the nucleating, crystallizing and feeding occurs within a total cycle time of less than 45 seconds.

27. The method of claim 21, wherein performance of the nucleating and crystallizing occurs within a total cycle time of less than 30 seconds.

28. A method of producing a semi-solid material without stirring, comprising:

heating a metal alloy to form a metallic melt;

preheating a temperature-controlled vessel to a selected vessel temperature prior to transferring metallic melt therein;

regulating the transfer of a select amount of the metallic melt into the vessel, the regulating comprising:

transferring the metallic melt into the vessel at a selected transfer temperature and at a selected transfer rate; and controlling a differential between the temperature of the metallic melt during the heating and the temperature of the metallic melt during the transferring; and crystallizing the metallic melt in the vessel by cooling the metallic melt at a controlled rate without the use of a grain refiner and without mechanical agitation at any point during the crystallizing to form a semi-solid material having a microstructure comprising rounded solid particles dispersed in a liquid metal matrix.

29. The method of claim 28, wherein the select amount of the metallic melt transferred in the vessel is between about 0.50 pounds and about 10 pounds.

30. The method of claim 28, wherein the selected transfer temperature is between the coherency temperature of the metal alloy and about 25 degrees Celsius above the liquidus temperature of the metal alloy; and wherein the selected transfer rate is between about 0.01 pounds per second and about 1.0 pounds per second.

31. The method of claim 28, wherein the regulating further comprises controlling a drop in temperature of the metallic melt during the transferring.

32. The method of claim 28, wherein the selected vessel temperature is approximately equal to the temperature of the metallic melt.

33. The method of claim 28, further comprising:

holding the metallic melt in an intermediate vessel prior to the transferring; and controllably adjusting the temperature of the metallic melt in the intermediate vessel to the selected transfer temperature.

34. The method of claim 28, wherein the controlled rate of cooling of the metallic melt is no greater than about 1.0 degree Celsius per second.

35. The method of claim 34, wherein rounded solid particles have a diameter no greater than about 50 $\mu$m.

36. The method of claim 34, wherein the controlled rate of cooling of the metallic melt is less than 0.5 degrees Celsius per second.

37. The method of claim 1, wherein the vessel includes a plurality of heat transfer zones; and wherein the cooling of the metallic melt at the controlled rate comprises independently controlling the temperature of the metallic melt disposed adjacent each of the heat transfer zones.

38. The method of claim 21, wherein the controlled rate of cooling of the metallic melt less than 0.5 degrees Celsius per second.

39. The method of claim 38, wherein the controlled rate of cooling of the metallic melt is within a range of about 0.01 degrees Celsius per second to about 0.5 degrees Celsius per second.

40. The method of claim 21, wherein the rounded solid particles have a diameter in a range between about 40 $\mu$m and about 50 $\mu$m.

41. The method of claim 21, wherein the regulating includes transferring the metallic melt into the vessel at a selected vessel temperature that is approximately equal to the temperature of the metallic melt.

42. The method of claim 21, wherein the regulating includes:

transferring the metallic melt into the vessel at a selected transfer temperature and at a selected transfer rate; and controlling a differential between the temperature of the metallic melt during the heating and the temperature of the metallic melt during the transferring.

43. The method of claim 42, wherein the selected transfer temperature is between the coherency temperature of the metal alloy and about 25 degrees Celsius above the liquidus temperature of the metal alloy; and wherein the selected transfer rate is between about 0.01 pounds per second and about 1.0 pounds per second.

44. The method of claim 21, further comprising:

holding the metallic melt in an intermediate vessel prior to the transferring; and controllably adjusting the temperature of the metallic melt in the intermediate vessel prior to the transferring.

45. The method of claim 21, wherein the vessel includes a plurality of heat transfer zones; and wherein the cooling of the metallic melt at the controlled rate comprises independently controlling the temperature of the metallic melt disposed adjacent each of the heat transfer zones.

* * * * *